US006002913A

United States Patent [19]

Pawlik et al.

[11] Patent Number: 6,002,913

[45] Date of Patent: Dec. 14, 1999

[54] XEROGRAPHIC FUSER MODULE WITH INTEGRAL SHEET DECURLER

[75] Inventors: Robert S. Pawlik, Webster; Michael E. Piccirilli, Penfield; Robert G. Pirwitz, Pittsford; Dennis N. Muck, Penfield; Dan Salotto, Rochester, all of N.Y.

[73] Assignee: Xerox Corporation, Stamford, Conn.

[21] Appl. No.: 09/186,296

[22] Filed: Nov. 5, 1998

[51] Int. Cl.[6] ..... G03G 15/20

[52] U.S. Cl. ..... 399/406; 162/271; 271/209

[58] Field of Search ..... 399/406; 271/161, 271/188, 209; 162/270, 271

[56] References Cited

U.S. PATENT DOCUMENTS

| | | | |
|---|---|---|---|
| 4,326,915 | 4/1982 | Mutschler, Jr. | 162/271 |
| 4,627,718 | 12/1986 | Wyer | 355/35 H |
| 5,084,731 | 1/1992 | Baruch | 355/208 |
| 5,183,454 | 2/1993 | Kurosawa et al. | 493/459 |
| 5,202,737 | 4/1993 | Hollar | 355/308 |
| 5,221,950 | 6/1993 | Ford et al. | 355/309 |
| 5,287,157 | 2/1994 | Miyazato et al. | 355/309 |
| 5,396,318 | 3/1995 | Asada | 355/285 |
| 5,398,107 | 3/1995 | Bartholmae et al. | 355/272 |
| 5,555,083 | 9/1996 | Kuo et al. | 355/309 |
| 5,565,971 | 10/1996 | Kuo et al. | 355/309 |
| 5,672,018 | 9/1997 | Yamamoto et al. | 400/613.3 |
| 5,787,331 | 7/1998 | Ohkuma et al. | 399/406 |
| 5,812,923 | 9/1998 | Yamauchi et al. | 399/388 |
| 5,848,347 | 12/1998 | Kuo et al. | 399/406 |

*Primary Examiner*—Richard Moses
*Attorney, Agent, or Firm*—R. Hutter

[57] ABSTRACT

A fuser module for a compact printer or copier includes therein a decurler which shares a common drive means with the fuser rolls. The decurler comprises a set of deformable rollers disposed on a decurling roll, the total length of deformable rollers being less than 25% of the effective length of the decurling roll. The module pivots open for jam clearance from either the fuser rolls or decurler.

25 Claims, 5 Drawing Sheets

XEROGRAPHIC FUSER MODULE WITH INTEGRAL SHEET DECURLER

FIELD OF THE INVENTION

The present invention relates to a sheet decurler which is particularly useful in small xerographic printers and copiers.

BACKGROUND OF THE INVENTION

In xerographic or electrostatographic printing, such as occurs in a copier or "laser printer," an image is created with marking material on a sheet, such as a sheet of paper or a transparency slide. At one point in the electrostatographic printing process, the sheet is typically heated, in a final fusing step, to permanently affix the marking material thereto.

As the sheet passes through the various processing stations in the printing apparatus, a curl or bend is frequently induced therein. This curl or bend may be inherent to the sheet material due to the method of manufacture thereof, or the curl can be induced by the interaction of a sheet with the processing stations within the printer. The curling of the sheet causes problems of handling as the sheet is processed within the printer, frequently producing jams or misfeeds within the printer. Even if the curl is only induced toward the end of the printing process, having curled output sheets is well known as a customer dissatisfier. The problem of sheet curling is particularly evident with relatively small printers or copiers, in which paper passing through the printer or copier must pass through a paper path having relatively tight changes in direction.

The present invention is directed to a decurling apparatus which is, in a preferred embodiment thereof, substantially integral with the fusing apparatus of an electrostatographic printer or copier. The decurling apparatus can be disposed within a replaceable fuser module.

DESCRIPTION OF THE PRIOR ART

In the prior art, U.S. Pat. 4,326,915 discloses a sheet decurler which presses a sheet into contact with a substantially rigid arcuate member in at least two regions.

U.S. Pat. 4,627,718 discloses a decurler that includes a pair of coacting rolls and a baffle extending across the path of a sheet exiting the nip between the rolls so as to deflect it about one of the rolls.

U.S. Pat. 5,084,731 discloses a fuser having a decurling mechanism associated therewith. A curl indicating device predicts the degree of inherent curl of a sheet, based on the amount of toner that had been placed on the sheet. A copy sheet having toned images having a charge value higher than a predetermined level is selectively deflected through a decurling nip.

U.S. Pat. 5,202,737 discloses a decurler including a rod deflecting a belt to define a nip therebetween. The belt is entrained about a pair of spaced rollers. The rod is adapted to translate in a vertical direction, and as the rod translates, the degree of deflection is varied and the bend of a sheet passing through the nip can be adjusted.

U.S. Pat. 5,221,950 discloses an idler roller assembly that prevents jams and image deletion in copier/printers by removing a corrugation in sheets before they reach sharp turns. The assembly includes a shaft into which idler rollers are mounted with the shaft having a bend in the middle in order to provide a condition to steer out any existing sheet corrugation.

U.S. Pat. 5,398,107 discloses an electrophotographic print engine in which the photoconductor drum interfaces with a transfer drum to form a transfer nip therebetween. Paper approaching the transfer nip is fed first between two precurl rollers. The durometers of the two precurl rollers are different, such that one roller will cause the other to compress. This causes the paper to have a curvature bias in the direction of the curvature of the photoconductor drum. Downstream of the photoconductor drum, the fuser mechanism has associated therewith two rollers which apply a curvature bias in the opposite direction to that provided by the precurl rollers, to return the paper to a substantially planar conformation.

U.S. Pat. 5,555,083 discloses a decurler for reducing cross-curl in sheets. The decurler includes at least one grooved elastomer transport belt and ribbed pinch shaft. The ribs of the decurler shaft extend into the grooves in the belt to provide one-sided corrugations to a passing sheet and provide distributed localized bending of a copy sheet in the area of the belt grooves.

The fuser module in the Xerox® Document Centres™ 265 product is removable from the printer, and pivots open for manual clearance of jammed paper. The design of the module can be seen in co-pending U.S. patent application Ser. No. 08/837,934, which application has been allowed as of the filing hereof.

SUMMARY OF THE INVENTION

According to one aspect of the present invention, there is provided an apparatus for decurling a sheet. The apparatus comprises a decurling roll, the decurling roll defining an axis and an effective length, and including along the effective length thereof at least two deformable rollers, the deformable rollers defining a first radius relative to the axis, and at least one hard roller defining a second radius relative to the axis, the second radius being less than the first radius. An idler roll, defining an axis disposed parallel to the axis of the decurling roll, is in direct contact with the hard roller and causes an indentation in the deformable rollers.

According to another aspect of the present invention, there is provided a fuser module for an electrostatographic printer. A first fuser roll and a second fuser roll are rotatably mounted and form a fuser nip therebetween for the passage of sheets therethrough. A decurling roll, defining an axis and an effective length, includes along the effective length thereof at least two deformable rollers, the deformable rollers defining a first radius relative to the axis, and at least one hard roller defining a second radius relative to the axis, the second radius being less than the first radius. An idler roll defines an axis disposed parallel to the axis of the decurling roll. The idler roll is in direct contact with the hard roller and causes an indentation in the deformable rollers. The decurling roll and the idler roll are disposed relative to the first fuser roll and the second fuser roll whereby a sheet passing through the fuser nip is caused to pass between the decurling roll and the idler roll.

According to another embodiment of the present invention, there is provided an electrostatographic printer. A first fuser roll and a second fuser roll are rotatably mounted within the printer and form a fuser nip therebetween for the passage of sheets therethrough. A decurling roll, defining an axis and an effective length, includes along the effective length thereof at least two deformable rollers, the deformable rollers defining a first radius relative to the axis, and at least one hard roller defining a second radius relative to the axis, the second radius being less than the first radius. An idler roll defines an axis disposed parallel to the axis of the decurling roll. The idler roll is in direct contact with the hard roller and causes an indentation in the deformable rollers. The decurling roll and the idler roll are disposed relative to the first fuser roll and the second fuser roll whereby a sheet passing through the fuser nip is caused to pass between the decurling roll and the idler roll.

According to another embodiment of the present invention, there is provided a decurling roll for decurling a sheet. The decurling roll defines an axis and an effective length. The decurling roll includes along the effective length thereof at least one deformable roller, the deformable roller defining a first radius relative to the axis, and at least one hard roller defining a second radius relative to the axis, the second radius being less than the first radius.

DETAILED DESCRIPTION OF THE INVENTION

Figure 1:
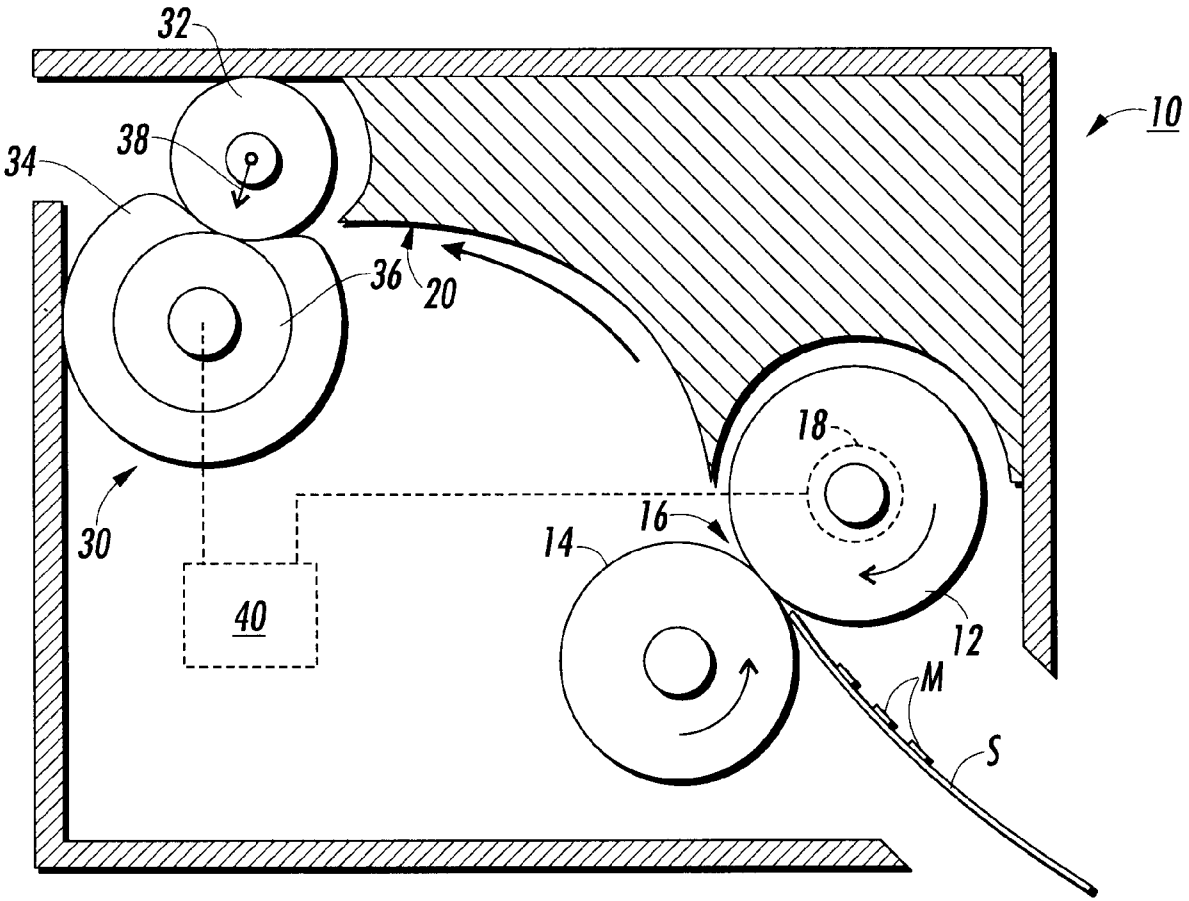
FIG. 1 is an elevational view of the essential elements of a decurler according to the present invention.

FIG. 1 is an elevational view showing a fuser module incorporating the decurling apparatus of the present invention. In a preferred embodiment of the invention, the decurling apparatus is contained within a fuser module, here indicated as 10, in combination with a fusing apparatus of a type known in electorstatographic printing. (For purposes of the following description and claims, a "printer" can be a digital printer, digital or light-lens copier, facsimile, or multifunction device.) The fuser module 10 typically includes a first fuser roll 12 and a second fuser roll 14. The fuser rolls are mounted to roll against each other and thus form a nip 16 therebetween for the passage of a sheet therethrough. Also, as common in the art, at least one of the fuser rolls, such as 12, may include therein a heat element such as 18, which, when electrical energy is applied thereto causes the fuser roll 12 to radiate heat. Thus, as shown in the Figure, a sheet S having a quantity of image-related marking material M on one side thereof is caused to move through fuser nip 16 by the rotation of fuser rolls 12 and 14, and the heat radiated from heating element 18 causes the marking material M to become affixed to the surface of sheet S.

With specific reference to the present invention, there is further provided within fuser module 10, a decurling apparatus disposed effectively downstream of the fuser rolls 12, 14 along a paper path of a sheet S passing through fuser nip 16. Sheets emerging from fuser nip 16 are caused to curve along a baffle 20, which in the present embodiment causes the sheet to curl in the direction shown, that is, away from the side of the sheet S having the marking material M (in the case of a simplex print).

The decurling apparatus comprises a rotatably-mounted "decurling roll" here indicated as 30, the specific structure of which will be described below, which operates in combination with an idler roll 32. Idler roll 32 is preferably a roller, rotatably mounted within the module 10, which defines an axis which is disposed parallel to the axis of rotation of the decurling roll 30. A sheet emerging from fuser nip 16 and passing over baffle 20 is caused to pass through a nip between decurling roll 30 and idler roll 32, and is thus effectively decurled by passing between decurling roll 30 and idler roll 32.

Figure 2:
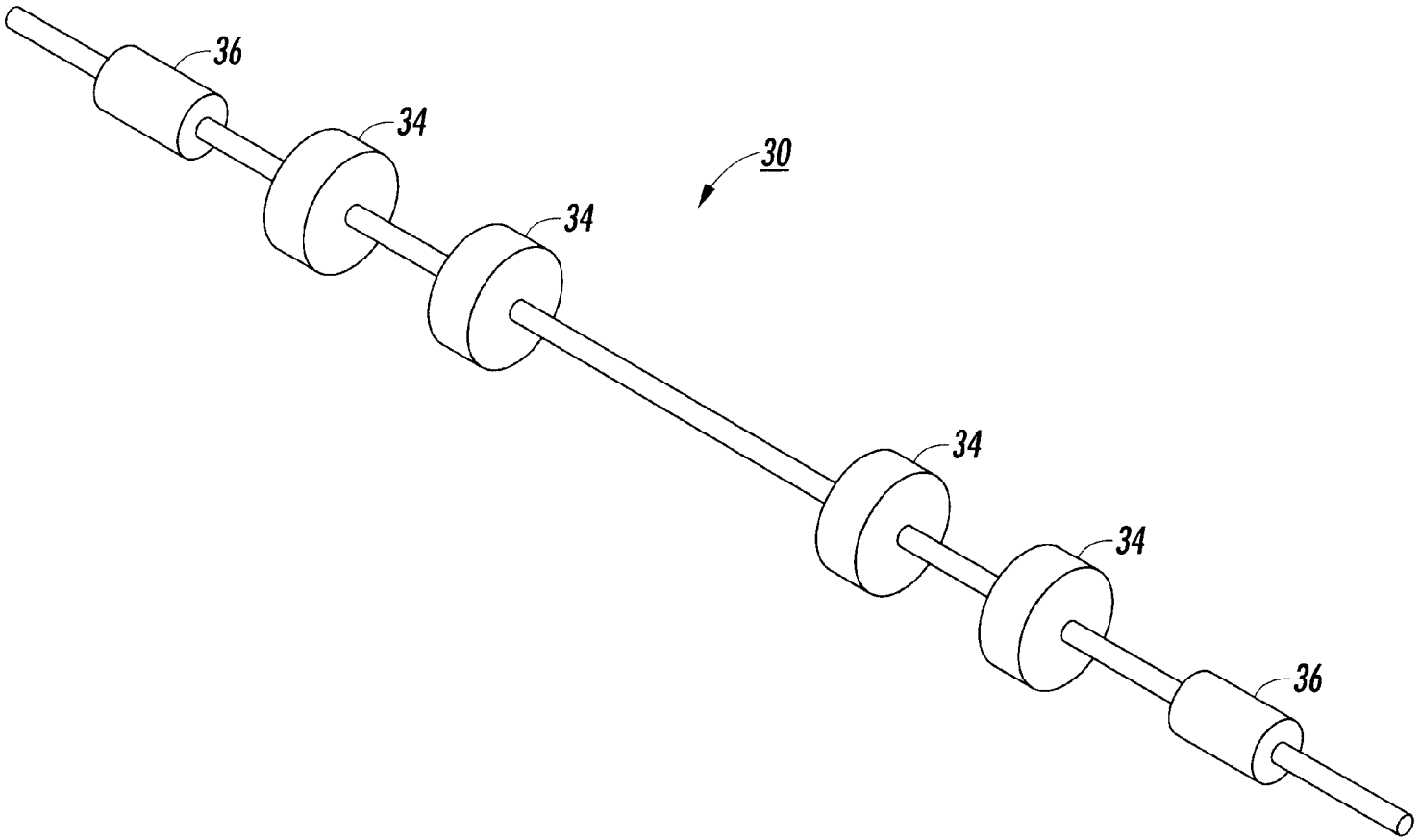
FIG. 2 is a perspective view showing a decurling roll used in the decurler of the present invention, in isolation.

FIG. 2 is a perspective view showing a preferred embodiment of an decurling roll 30 used in the fuser module 10, in isolation. For purposes of the claims hereinbelow decurling roll 30 defines an axis about which it rotates within fuser roll 10, and, along the length of this axis, an "effective length". The effective length of decurling roll 30 is the length along the axis of decurling roll 30 generally corresponding to the width of a sheet S passing over decurling roll 30. In a letter-size, short-edge-feed copier or printer, a typical effective length of decurling roll 30 would be about nine inches, or about 230 mm.

Disposed along the effective length of decurling roll 30 are a number of smaller rollers, which are intended to be rigidly attached to the axis of decurling roll 30. In the embodiment shown in FIG. 2, there is provided in this embodiment four relatively soft deformable rollers, indicated as 34 and placed as shown, and two relatively hard rollers 36, also known as "velocity control rings," placed as shown. Significantly, the deformable rollers 34 define a radius from the axis of decurling roll 30 which is significantly larger than the radius of the hard rollers 36. Thus, when the idler roll 32, which is of a uniform radius throughout its effective length, is disposed or urged against the decurling roll 30, the deformable rollers 34, which are relatively soft, are effectively indented when the idler roll 32 contacts the hard rollers 36. An illustration of this indentation can be seen in FIG. 1. This deliberate indentation of the large-radius, relatively soft deformable rollers 34 is intended to create a decurling nip through which a sheet S moving along baffle 20 may pass. By passing through the nip formed between decurling roll 30 and idler roll 32, the sheet S is in effect curled in a direction opposite that formed by the curve of baffle 20, with the overall effect that the sheet S is decurled when it leaves fuser module 10.

The hard rollers 36 on decurling roll 30, also known as "velocity control rings," serve an important function within the fuser module 10. The velocity control rings, because they are not deformed by contact with idler roll 32, engage a sheet passing through the module in a predictable manner, and move the sheet along at a predictable speed. Ideally the velocity control rings should move the sheet at the same speed as the fuser rolls 12 and 14 are moving the sheet, so as to avoid tearing or buckling of the sheet passing through the module 10.

According to a preferred embodiment of the present invention, the total length of all of the deformable rollers 34 along the effective length of decurling roll 30 should be less than 25 percent of the effective length of the decurling roll 30. In one practical embodiment of the present invention, there are provided four such deformable rollers 34, each with a width of 10 mm, for a total length of the decurling rollers of 40 mm along an effective length of 230 mm. Similarly, it is also preferred that the total length of the hard rollers 36 be less than 25 percent of the effective length of the decurling roll 30. The reason for the relative shortness of the deformable rollers 34 and hard rollers 36 is that the deformable rollers 34 exert a pressure against the idler roll 32 when they are deformed or indented as shown in FIG. 1; the total length of the deformable rollers 34 should be just enough to perform the decurling without placing an unnecessarily high spring force against idler roll 32. The purpose of the hard rollers 36 is to restrict the amount of indentation of the deformable rollers 34 to a predictable amount, which is facilitated by the "hard" positioning of the idler roll 32 against the hard rollers 36. In addition, in a preferred embodiment of the present invention there may further be provided a spring force, indicated in FIG. 1 as 38 and typically provided by a coil spring (not shown), which urges the idler roll 32 against the decurling roll 30.

A preferred material for the deformable rollers 34 is porous silicone.

In a preferred embodiment of the invention, fuser roll 12 and the decurling roll 30 are preferably driven by a common drive means, indicated in FIG. 1 schematically as 40, which would typically include an arrangement of gears, pulleys, etc., which in turn would connect to a drive system external to the module 10, such as within a copier or printer.

Figure 3:
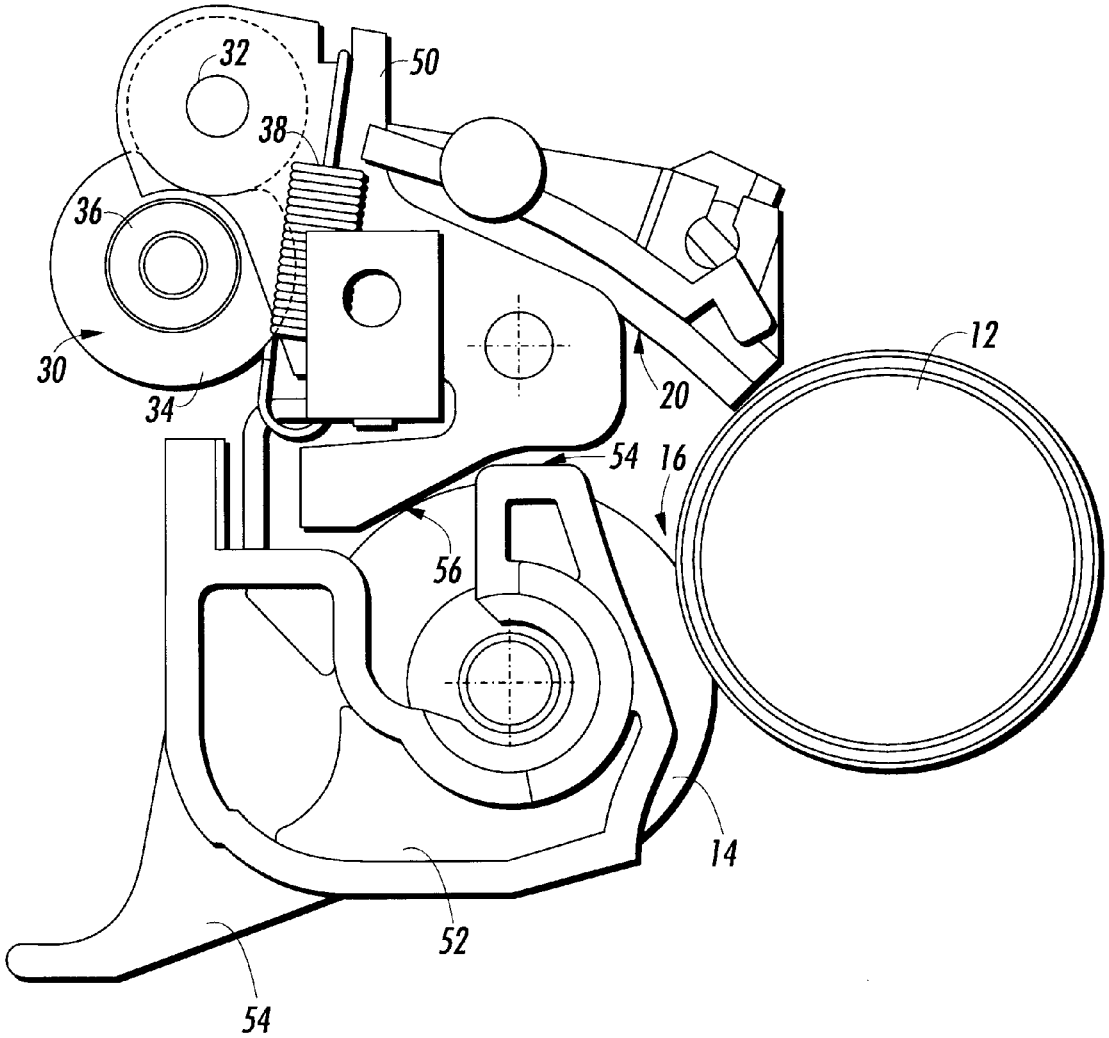
FIGS. 3 and 4 are views of a preferred embodiment of a decurler of the present invention illustrating the decurler in closed and open positions respectively.

FIG. 3 is an elevational view showing a practical implementation of the combination fuser assembly-decurling apparatus shown in FIG. 1. In FIGS. 1 and 3, like numerals indicate like elements, although some of the elements in FIG. 1 are obscured by the particular construction of the embodiment of FIG. 3. Significantly in FIG. 3, the spring force shown in FIG. 1 as 38 is illustrated as a coil spring 38 which urges the idler roll 32 against decurling roll 30. In a preferred embodiment of the present invention, springs such as 38 should be so placed that the spring force exerted thereby is largely loaded onto the hard rollers 36, such as at the ends of the effective length of decurling roll 30.

The particular embodiment shown in FIG. 3 illustrates a preferred feature of the present invention, namely, a "jam clearance" by which the combination fuser and decurler can pivot open so that a sheet which happens to be stuck within the assembly can be removed by hand. Pursuant to this desired feature, the practical embodiment shown in FIG. 3 includes two relatively-pivotable portions on which the various rollers are mounted, a top portion indicated as 50 and a bottom portion indicated as 52. Bottom portion 52 may further include a small handle 54 which extends in a direction so that a user can pivot open the assembly when the assembly is disposed either within a module 10, or within a larger printing apparatus.

Figure 4:
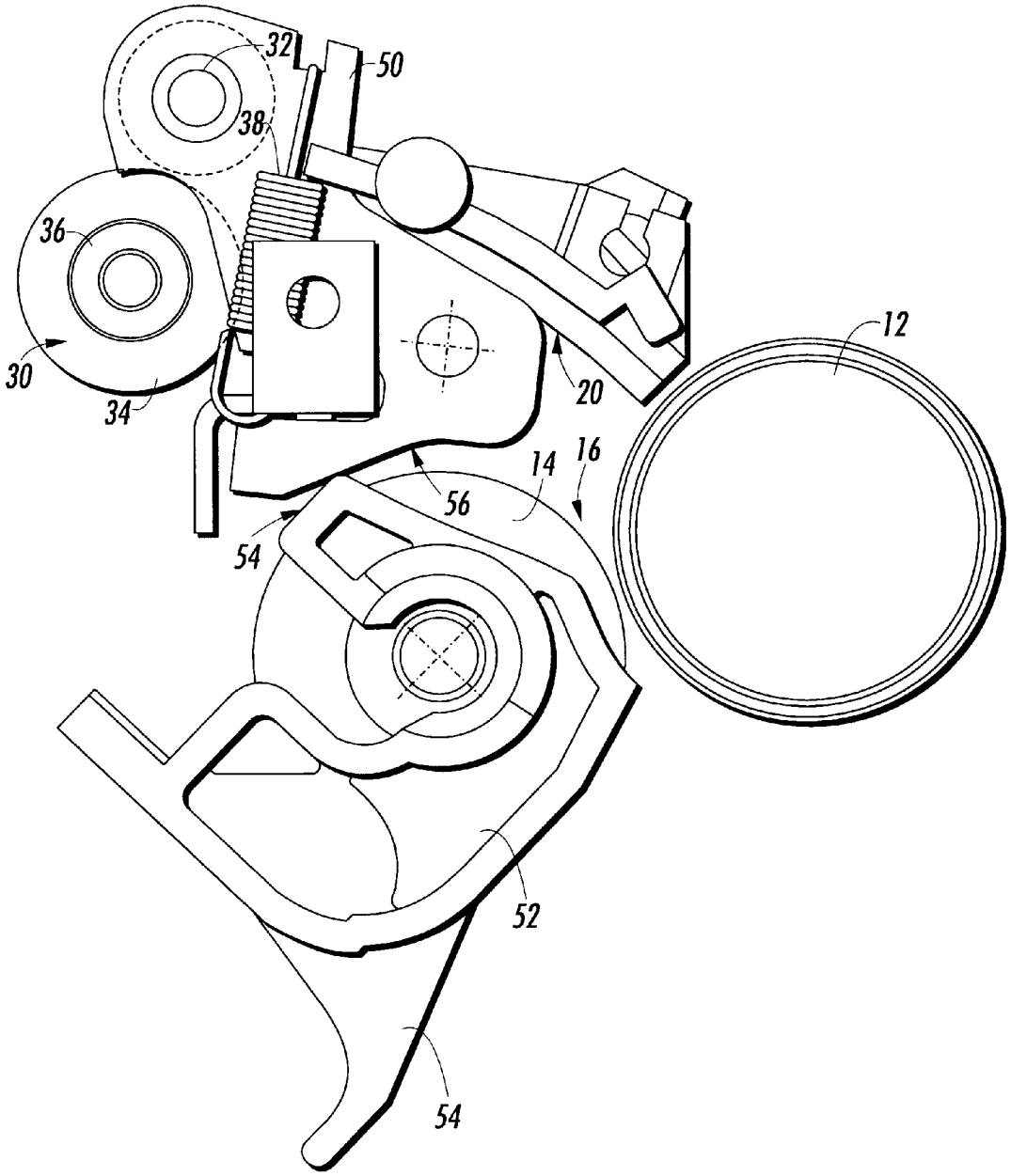

In the illustrated embodiment, the bottom portion 52 pivots around the axis of fuser roll 14. When the bottom portion 52 pivots around the axis of fuser roll 14, a top surface 54 of bottom portion 52 engages surface 56 of the top portion 50, and this contact causes top portion 50 to be pushed upwards when bottom portion 52 is pivoted open. By the particular configuration of parts in the embodiment of FIG. 3, this has the effect of separating both decurling roll 30 from idler roll 32, and also separating fuser roll 14 from fuser roll 12. In this way, a sheet which is caught anywhere within the assembly can be removed by hand. FIG. 4 is a view showing the relationship of top portion 50 and bottom portion 52 when the assembly is pivoted open for jam clearance: the contact between top surface 54 and surface 56 can be seen to be pulling apart both the fuser rolls 12, 14 and separating the idler roll 32 from decurling roll 30.

Figure 5:
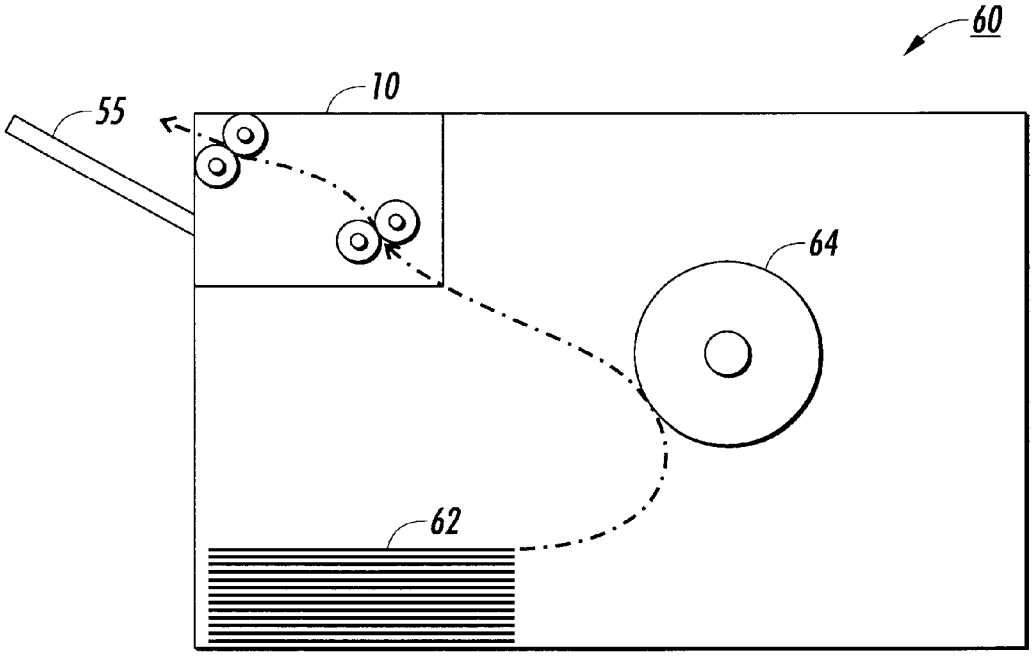
FIG. 5 is a simplified view showing essential portions of an electrostatographic printer or copier showing the disposition of a fuser module incorporating the present invention within a larger apparatus.

FIG. 5 is a simplified elevational view showing some essential portions of an electrostatographic printer, which could be, for example, a "laser" printer, light-lens copier, facsimile, or multifunction device, showing the placement of a fuser module 10 incorporating the present invention wherein. Other typical portions of a printer 60 include a paper supply stack 62, a photoreceptor drum 64 (with, of course, its accompanying elements, not shown), and output tray 66. The fuser module 10 is preferably a removable, replaceable module within printer 60.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. An apparatus for decurling a sheet, comprising:

a decurling roll, the decurling roll defining an axis and an effective length, the decurling roll including along the effective length thereof at least one deformable roller, the deformable roller defining a first radius relative to the axis, and at least one hard roller defining a second radius relative to the axis, the second radius being less than the first radius; and an idler roll, defining an axis disposed parallel to the axis of the decurling roll, the idler roll defining a surface in direct contact with the hard roller and the deformable roller and causing an indentation in the deformable rollers.

2. The apparatus of claim 1, further comprising spring means for urging the idler roll against the decurling roll.

3. The apparatus of claim 2, the spring means being primarily loaded at a location corresponding to a hard roller of the decurling roll.

4. The apparatus of claim 1, wherein a total length of all deformable rollers is less than 25% of the effective length of the decurling roll.

5. The apparatus of claim 1, wherein a total length of all hard rollers is less than 25% of the effective length of the decurling roll.

6. The apparatus of claim 1, wherein the deformable roller comprises porous silicone.

7. A fuser module for an electrostatographic printer, comprising:

a first fuser roll and a second fuser roll, rotatably mounted and forming a fuser nip therebetween for the passage of sheets therethrough;

a decurling roll, the decurling roll defining an axis and an effective length, the decurling roll including along the effective length thereof at least one deformable roller, the deformable roller defining a first radius relative to the axis, and at least one hard roller defining a second radius relative to the axis, the second radius being less than the first radius; and an idler roll, defining an axis disposed parallel to the axis of the decurling roll, the idler roll defining a surface in direct contact with the hard roller and the deformable roller and causing an indentation in the deformable roller;

the decurling roll and the idler roll being disposed relative to the first fuser roll and the second fuser roll whereby a sheet passing through the fuser nip is caused to pass between the decurling roll and the idler roll.

8. The fuser module of claim 7, further comprising spring means for urging the idler roll against the decurling roll.

9. The fuser module of claim 8, the spring means being primarily loaded at a location corresponding to the hard roller of the decurling roll.

10. The fuser module of claim 7, wherein a total length of all deformable rollers is less than 25% of the effective length of the decurling roll.

11. The fuser module of claim 7, wherein a total length of all hard rollers is less than 25% of the effective length of the decurling roll.

12. The fuser module of claim 7, further comprising common means for driving the decurler roll and at least one of the first fuser roll and the second fuser roll.

13. The fuser module of claim 7, further comprising a baffle disposed between the fuser nip and the decurling roll, the baffle causing a sheet emerging from the fuser nip to be directed in a first curve direction, and whereby the sheet passing between the decurling roll and the idler roll is directed in a second curve direction opposite the first curve direction.

14. The fuser module of claim 7, wherein the deformable roller comprises porous silicone.

15. The fuser module of claim 7, wherein the decurler roll is pivotably mounted within the fuser module so that the decurler roll can be disengaged from the idler roll.

16. The fuser module of claim 15, further comprising a mechanism whereby, when the decurler roll is disengaged from the idler roll, the first fuser roll and second fuser roll are separated.

17. An electrostatographic printer, comprising:

a first fuser roll and a second fuser roll, rotatably mounted relative to each other and forming a fuser nip therebetween for the passage of sheets therethrough;

a decurling roll, the decurling roll defining an axis and an effective length, the decurling roll including along the effective length thereof at least one deformable roller, the deformable roller defining a first radius relative to the axis, and at least one hard roller defining a second radius relative to the axis, the second radius being less than the first radius; and an idler roll, defining an axis disposed parallel to the axis of the decurling roll, the idler roll defining a surface in direct contact with the hard roller and the deformable roller and causing an indentation in the deformable roller;

the decurling roll and the idler roll being disposed relative to the first fuser roll and the second fuser roll whereby a sheet passing through the fuser nip is caused to pass between the decurling roll and the idler roll.

18. The printer of claim 17, wherein a total length of all deformable rollers is less than 25% of the effective length of the decurling roll.

19. The printer of claim 17, further comprising a baffle disposed between the fuser nip and the decurling roll, the baffle causing a sheet emerging from the fuser nip to be directed in a first curve direction, and whereby the sheet passing between the decurling roll and the idler roll is directed in a second curve direction opposite the first curve direction.

20. The printer of claim 17, wherein the decurler roll is pivotably mounted within the printer so that the decurler roll can be disengaged from the idler roll.

21. The printer of claim 20, further comprising a mechanism whereby, when the decurler roll is disengaged from the idler roll, the first fuser roll and second fuser roll are separated.

22. A decurling roll for decurling a sheet, the decurling roll defining an axis and an effective length, the effective lenath corresponding to a dimension of the sheet, the decurling roll comprising along the effective length thereof at least one deformable roller, the deformable roller defining a first radius relative to the axis, and at least one hard roller defining a second radius relative to the axis, the second radius being less than the first radius.

23. The decurling roll of claim 22, wherein a total length of all deformable rollers is less than 25% of the effective length of the decurling roll.

24. The decurling roll of claim 22, wherein a total length of all hard rollers is less than 25% of the effective length of the decurling roll.

25. The decurling roil of claim 22, wherein the deformable roller comprises porous silicone.

* * * * *